United States Patent [19]

Roden et al.

[11] Patent Number: 4,991,254

[45] Date of Patent: Feb. 12, 1991

[54] CLEANING SYSTEM

[75] Inventors: James R. Roden, Phoenix; Michael J. Roden, Gilbert, both of Ariz.

[73] Assignee: Professional Chemicals Corporation, Chandler, Ariz.

[21] Appl. No.: 519,000

[22] Filed: May 4, 1990

Related U.S. Application Data

[63] Continuation-in-part of Ser. No. 286,616, Dec. 19, 1988, Pat. No. 4,940,082.

[51] Int. Cl.[5] ..... A47L 11/34; F25B 29/00

[52] U.S. Cl. ..... 15/321; 15/340.1; 165/51

[58] Field of Search ..... 15/321, 320, 340.1; 165/51

[56] References Cited

U.S. PATENT DOCUMENTS

| | | | |
|---|---|---|---|
| 3,594,849 | 7/1971 | Coshow | 15/321 |
| 4,109,340 | 8/1978 | Bates | 15/321 |
| 4,158,248 | 6/1979 | Palmer | 15/321 |
| 4,284,127 | 8/1981 | Collier et al. | 165/35 |
| 4,336,627 | 6/1982 | Bascus | 15/321 |
| 4,443,909 | 4/1984 | Cameron | 15/321 X |
| 4,593,753 | 6/1986 | McConnell | 165/51 |
| 4,803,446 | 2/1989 | Gurstein et al. | 15/321 X |
| 4,862,551 | 9/1989 | Martinez et al. | 15/321 |
| 4,949,424 | 8/1990 | Shero | 15/321 |

*Primary Examiner*—Chris K. Moore

*Attorney, Agent, or Firm*—Cahill, Sutton & Thomas

[57] ABSTRACT

A cleaning system utilizes heat from an internal combustion engine to heat cleaning liquid which is sprayed onto a surface to be cleaned. The internal combustion engine drives a vacuum pump which withdraws air and cleaning liquid through a vacuum nozzle for retrieving cleaning liquid and soil. The heated air leaving a vacuum pump is combined with heated exhaust gasses from said engine and heat from the mixture is extracted to heat the cleaning liquid. The cleaning liquid may be further heated by heat extracted from the engine by a cooling system.

9 Claims, 2 Drawing Sheets

CLEANING SYSTEM

This application is a continuation-in-part of application Ser. No. 07/286,616 filed Dec. 19, 1988 now U.S. Pat. No. 4,940,082, issued July 10, 1990, for "CLEANING SYSTEM AND LIQUID HEATING SYSTEM THEREFOR", and assigned to the same assignee as the present application.

TECHNICAL FIELD

This invention is concerned with liquid heating systems, particularly those suitable for heating cleaning liquid in portable cleaning systems.

BACKGROUND ART

A variety of services are available today for inhouse cleaning of carpets and upholstery. These services utilize equipment for heating cleaning liquid which is conveyed under pressure to and sprayed onto the surface to be cleaned and then vacuum removed from the surface with the soil. This equipment, which often includes an internal combustion engine for driving the cleaning liquid and vacuum pumps, is usually mounted in a panel truck, or van, for ease of transport.

It has been suggested that instead of using a separate heater for heating the cleaning liquid that waste heat from the internal combustion engine be used for that purpose. U.S. Pat. No. 4,593,753, granted June 10, 1986 to P. J. McConnell for "EXHAUST GAS LIQUID HEATING SYSTEM FOR INTERNAL COMBUSTION ENGINES" discloses a system for heating water with exhaust gas heat. U.S. Pat. No. 4,109,340 granted Aug. 29, 1978 to L. E. Bates for "TRUCK MOUNTED CARPET CLEANING MACHINE" discloses a system in which the cleaning liquid is passed first through the cylinder block of a liquid cooled, internal combustion engine and then through a heat exchanger which also has engine exhaust gases passing therethrough. U.S. Pat. No. 4,284,127 granted Aug. 18, 1981 to D. S. Collier et al for "CARPET CLEANING SYSTEMS" discloses a similar system which directs the cleaning liquid through a first heat exchanger into which the liquid engine coolant also is directed. The preheated cleaning liquid then passes through a second heat exchanger where it extracts heat from the engine exhaust gases.

In all of the aforementioned systems in which the cleaning liquid is directed in heat exchange relationship with the exhaust gases of the internal combustion engine there is a danger that the cleaning liquid could become overheated. To avoid damage to surfaces to be cleaned the temperature of the cleaning liquid, as a general rule, should not exceed 220° F. Internal combustion engine exhaust gases can reach temperatures as high as 1200° F. With the engine running and a low flow rate for the cleaning liquid the latter can rapidly be heated to an undesirably high temperature in the exhaust gas heat exchange. It has been customary, therefore, to incorporate into such systems a thermostatically controlled dump valve for dumping the overheated cleaning liquid before it can reach the surface to be cleaned. One such dumping arrangement is described hereinafter and in the aforementioned co-pending application Ser. No. 07/286,616.

U.S. Pat. No. 3,594,849 granted July 27, 1971 to C. L. Coshow for "CLEANING APPARATUS" discloses a cleaning system in which air and heated cleaning fluid being withdrawn from a carpet is conveyed in heat exchange relationship with cleaning liquid being conveyed to the carpet. Little benefit, if any, is derived from this relationship a it would seem to decrease, rather than increase the temperature of the cleaning liquid being conveyed to the carpet.

The aforementioned co-pending application Ser. No. 07/286,616 propose utilization of the heat contained in the return air stream after it has passed through the vacuum pump. Because the vacuum pump adds a significant quantity of heat to this air stream useful heat can be obtained from its exhaust and imparted to the cleaning liquid being heated. This feature of that application is carried over and constitutes a part of the invention covered by the present application. It should be noted, however, that co-pending application Ser. No. 07/286,616 offered no suggestions for preventing overheating of the cleaning liquid in heat exchange relationship with the engine exhaust gases.

DISCLOSURE OF THE INVENTION

This invention contemplates extracting heat both from the exhaust gases of an internal combustion engine and the air exiting a vacuum pump to heat the cleaning liquid. Moreover, the invention contemplates mixing the heat from these two sources before imparting it to the cleaning liquid. This is preferably done by mixing the exhaust gases and the air from the vacuum pump before placing the mixture in heat exchange relationship with the cleaning liquid. The resulting mixture is at a temperature sufficient to heat the cleaning liquid but not so high as to overheat the liquid as the exhaust gases alone are prone to do. Heat from a cooling system for the internal combustion engine is also utilized to further heat the cleaning liquid.

BRIEF DESCRIPTION OF THE DRAWINGS

The invention is described in greater detail hereinafter by reference to the accompanying drawings wherein.

BEST MODES FOR CARRYING OUT THE INVENTION

Figures 1, 2:
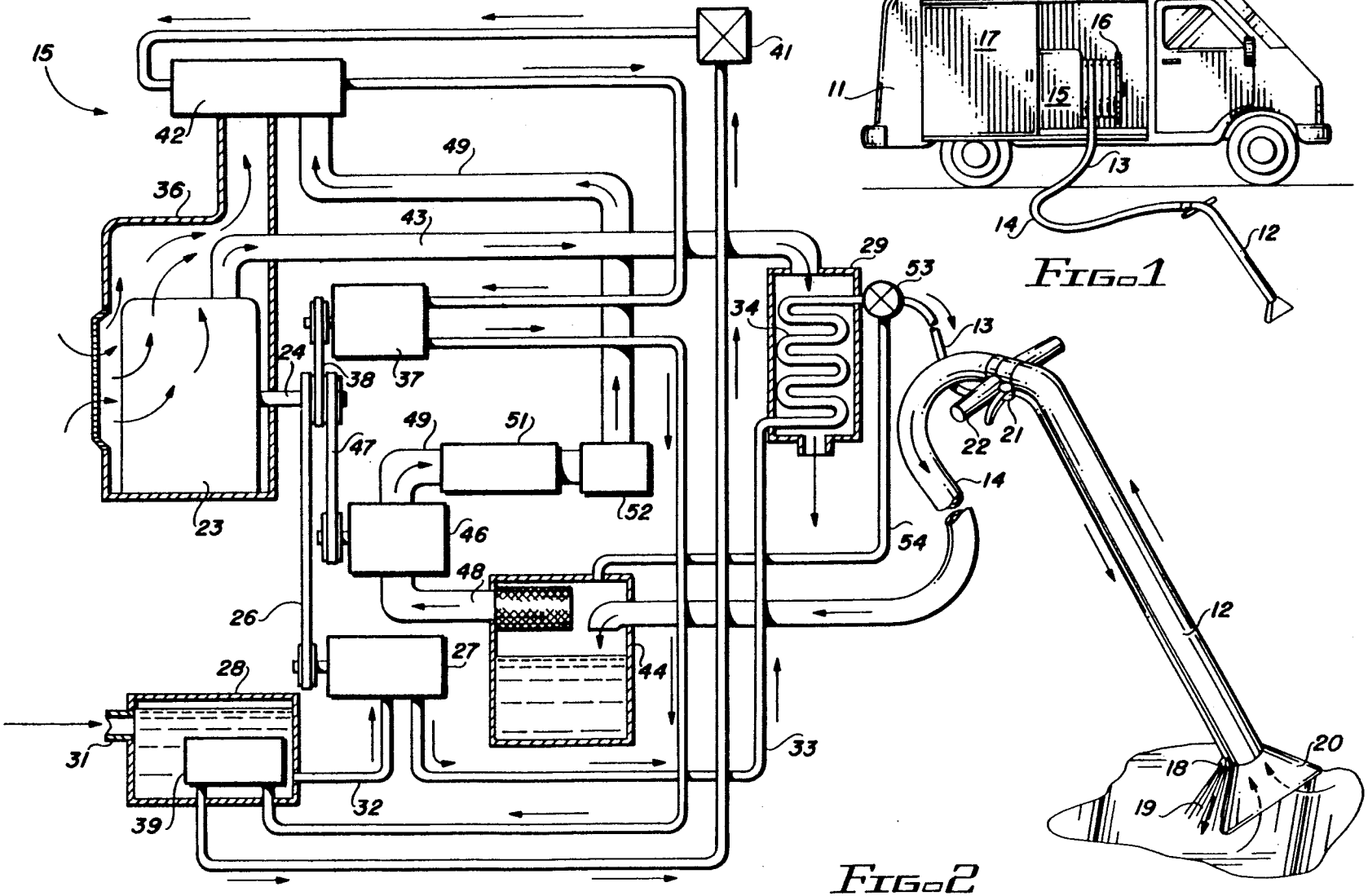
FIG. 1 is a side elevational view of a van equipped with a cleaning system embodying the invention.
FIG. 2 is a diagrammatic representation of a cleaning system embodying the invention.

Illustrated in FIG. 1 is a portable carpet and fabric cleaning system of the type commonly in use today. The system comprises a panel truck, or van, 11, a cleaning wand 12 coupled by means of hoses 13 and 14 to a cleaning liquid supply and retrieval unit housed in the truck. Hoses 13 and 14 may be stored on a reel 16. Truck 11 is provided with a door 17 to give access to the cleaning equipment.

Wand 12 is provided at its distal end with a spray nozzle 18 which has cleaning liquid 19 supplied thereto under pressure via high pressure hose 13 (see FIG. 2). The wand 12 further includes a vacuum nozzle 20 adjoining the area of the surface to be cleaned which is subjected to the spray of cleaning liquid 19 from spray nozzle 18. Vacuum nozzle 20 is in communication with vacuum hose 14.

In use, the wand 12 is drawn across the surface to be cleaned so that a progressive area of the surface is subjected to a spray of hot cleaning liquid from nozzle 18. The cleaning liquid imparted to the surface is thereafter vacuumed by nozzle 20 to remove most of the cleaning liquid and any loosened soil from the surface. The flow of cleaning liquid 19 to nozzle 18 is controlled by the operator by means of a hand manipulated valve 21 in pressure hose 13 near the wand handle 22.

The composition of the cleaning liquid 19 may vary depending upon the surface to be cleaned, but usually comprises a detergent and a surfactant admixed with water.

The components of the cleaning liquid supply and retrieval unit 15 are illustrated diagrammatically in FIG. 2. At the heart of this unit 15 is a multipurpose, air cooled, internal combustion engine 23. Energy to operate the engine 23 is supplied by any transportable fuel such as gasoline or propane.

One function performed by engine 23 is the pressurization and propelling of cleaning liquid through hose 13 to spray nozzle 18 on cleaning wand 12. To accomplish this the drive shaft 24 of engine 23 is connected by a belt drive 26 to a cleaning liquid pump 27. Pump 27 and associated piping constitute means for conveying cleaning liquid through first and second heat exchangers, designated 28 and 29, respectively, wherein the cleaning liquid is heated.

Cleaning liquid enters heat exchanger 28 via an inlet conduit 31 from a supply source (not shown). The cleaning liquid is withdrawn from heat exchanger 28 through a low pressure pipe 32 by pump 27 and is conveyed in a high pressure pipe 33 to a coil 34 within heat exchanger 29. The heated cleaning liquid exits second heat exchanger 29 via high pressure hose 13 connected to cleaning wand 12.

The second function performed by internal combustion engine 23 is to supply waste heat energy to heat the cleaning liquid passing through heat exchangers 28 and 29. Two sources of heat energy from engine 23 are utilized; the first source is heat in the cooling air exiting the engine and the second source is the heat in the exhaust gases exiting the engine.

Internal combustion engine 23 is surrounded by a shroud 36 which functions as means for confining the cooling air passing over the engine and as means for conveying this cooling air away from the engine in a controlled manner.

Heat is extracted from cooling air passing through shroud 36 and imparted to cleaning liquid in the first heat exchanger 28 by means of a heat pump which is also driven by engine 23. The heat pump includes a compressor 37 which is driven by a belt drive 38 coupled to the drive shaft 24 of engine 23. The heat pump also includes a condenser 39 associated with the first heat exchanger 28, an expansion device 41 and an evaporator 42 associated with the shroud 3 conveying cooling air away from the engine 23.

The heat pump compressor 37, condenser 39, expansion device 41 and evaporator 42 are connected in a closed loop by tubing and charged with a suitable refrigerant, such as trichlorofluoromethane. In operation, gaseous refrigerant compressed by the compressor 37 is condensed in condenser 39 giving up its heat of condensation to cleaning liquid in heat exchanger 28. The liquid refrigerant next passes through expansion device 41 into a low pressure portion of the heat pump circuit which includes evaporator 42. The refrigerant absorbs heat from the engine cooling air as the latter passes over the evaporator. This causes evaporation of the refrigerant which is drawn into and compressed by the engine driven compressor 37. In this manner heat energy is transferred from the engine cooling air to the cleaning liquid passing through heat exchanger 28.

The principal advantage to employing a heat pump to extract heat from the engine cooling air is that this makes it possible to substantially reduce the temperature of exiting cooling air below the temperature to which the cleaning liquid is being heated in first heat exchanger 28. With a properly balanced system the engine cooling air can be reduced in temperature to ambient air temperature so that the cooling air does not heat up the interior of the truck 11 when the system is operated.

In a typical water heating operation with ambient air at 80° F., the hot cooling air conveyed away from engine 23 may be cooled by evaporator 42 back to 80° F. The heat thus extracted is released by condenser 39 into heat exchanger 28 to heat the cleaning liquid therein to around 140° F.

It is significant to note that any waste heat generated by engine 23 as a result of having to drive the compressor 37 of the heat pump is simply extracted from the cooling air and further used to heat the cleaning liquid.

As mentioned, the exhaust gases from engine 23 provide a second source of heat energy to further heat the cleaning liquid in heat exchanger 29 after the liquid has been preheated in heat exchanger 28. For this purpose the engine 23 is equipped with an exhaust pipe 43 which functions as means for conveying exhaust gases away from the engine. The exhaust pipe 43 is associated with and communicates with the interior of heat exchanger 29. Hot exhaust gases, which may be of the order of 600° F. to 1200° F., passing over coil 34 in heat exchanger 29 heat the cleaning liquid to a temperature of from 180° F. to 200° F. which is sufficiently hot to provide good cleaning action by the cleaning liquid. And all of the heating is provided without using any auxiliary heater such as the oil fired heater required in some cleaning systems.

The final function performed by internal combustion engine 23 is the creation of a vacuum to draw cleaning liquid, air and soil into the vacuum nozzle 20 on wand 12 and to convey the waste cleaning liquid and soil to a waste storage tank 44. Engine 23 drives a vacuum pump 46 through a belt drive 47 working off of drive shaft 24.

Vacuum pump 46 is in communication with the interior of waste tank 44 through pipe 48. The vacuum created within tank 44 draws the air/waste cleaning liquid/soil mixture through vacuum hose 14 into tank 44 where most of the cleaning liquid and soil separate from the air which is drawn into the vacuum pump 46.

The air expelled from vacuum pump 46 through discharge pipe 49 contains heat which can be employed in the cleaning water heating circuit. Much of this heat is imparted to the air during the period when the air is admixed with waste cleaning liquid in vacuum hose 14. Additional heat is imparted to the air when it is compressed in vacuum pump 46. By directing air discharge pipe 49 to the evaporator 42 of the heat pump the heat in the discharge air can be extracted by the evaporator and conveyed to the first heat exchanger 28 in the cleaning liquid heating circuit in the same manner as heat is extracted and delivered from the cooling air from the engine.

If desired, a muffler 51 and a liquid separator 52 may be interposed in discharge air pipe 49. The muffler 51 reduces emission of noise from vacuum pump 46. The separator 52 functions to recover any liquid remaining in the exhaust air to insure that it will not accumulate and possibly freeze on evaporator 42.

With the liquid supply and retrieval unit 15 operating as described above it is possible to overheat the cleaning liquid if the engine 23 is run for some considerable period of time with cleaning liquid flow control valve 21 closed. Liquid at a temperature in excess of 220° F. can damage some surfaces, so it is desirable to prevent the delivery of such high temperature liquid to cleaning wand 12. This is accomplished by a thermostatically controlled dump valve 53 in high pressure hose 13 at the exit of second heat exchanger 29. When valve 53 detects cleaning liquid temperature in excess of 220° F. it opens dumping the over heated cleaning liquid into waste tank 44 via pipe 54. Of course, when valve 53 detects that cleaning liquid at the exit from heat exchanger 29 has a temperature within the desired range it closes to stop the dumping of liquid.

Figure 3:
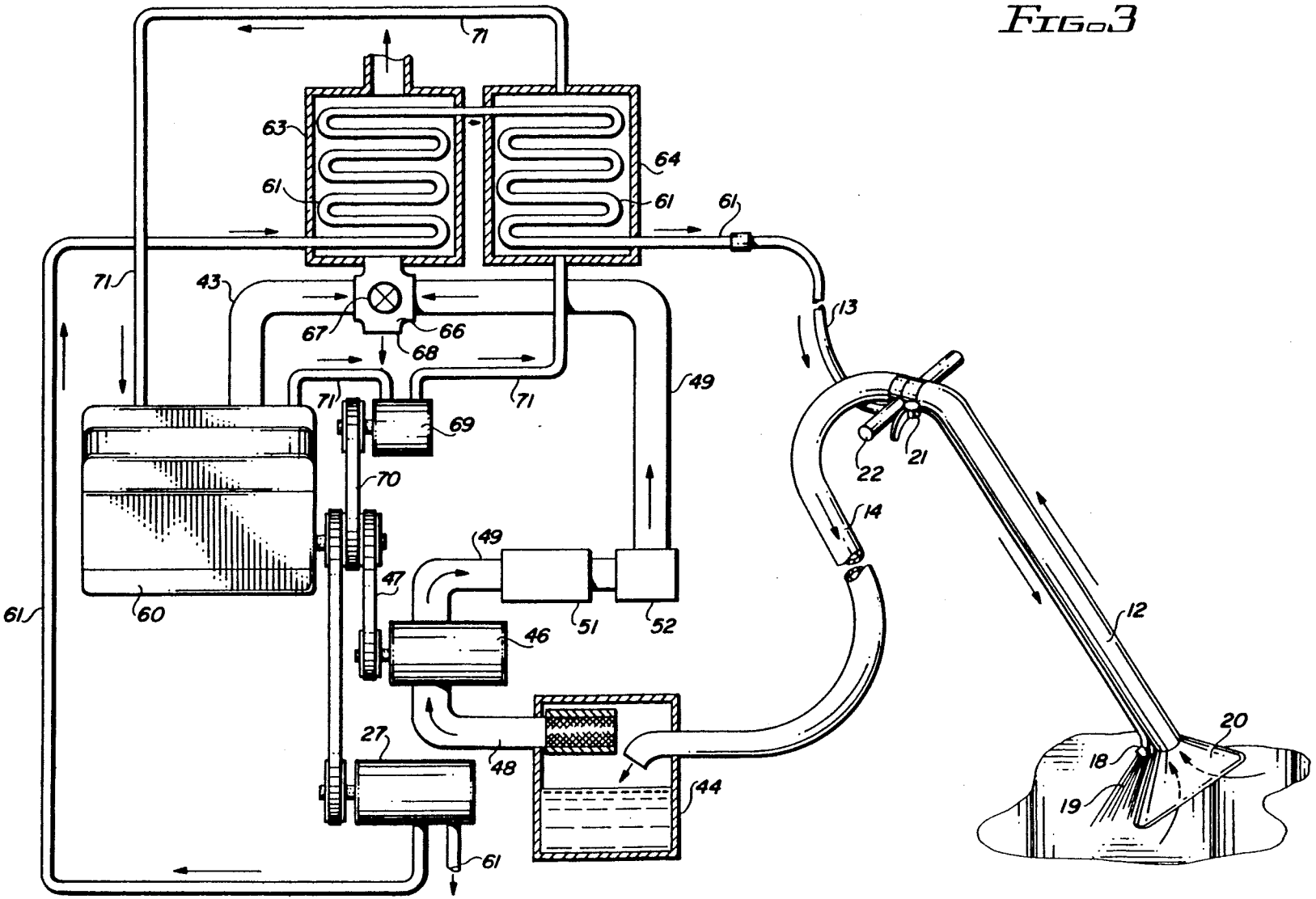
FIG. 3 is a diagrammatic representation of another cleaning system embodying another form of the invention.

FIG. 3 illustrates another mode for carrying out the invention. Components of the cleaning liquid supply and retrieval unit in FIG. 3 which function in the same manner as the components of the unit shown in FIG. 2 are identified by like reference numerals. For example, the FIG. 3 unit employs a cleaning wand 12 to which heated cleaning liquid is supplied by a high pressure hose 13 and from which air, spent cleaning liquid and soil are withdrawn through a vacuum hose 14. Unlike the previously described embodiment of the invention, the unit shown in FIG. 3 preferably employs a liquid cooled internal combustion engine 60. Engine 60 performs several functions by driving several different pumps. Through belt drive 26 engine 60 drives cleaning liquid pump 27. The pump 27 withdraws cleaning liquid from a source (not shown) through a pipe 61 and forces the liquid through a pipe 62 which passes through first and second heat exchangers 63 and 64, respectively, and which then connects with high pressure wand hose 13.

Engine 60 also drives vacuum pump 46 through another belt drive 47. Vacuum pump 46 is in communication with the interior of waste storage tank 44 through pipe 48. The vacuum created in tank 44 draws the air/waste cleaning liquid/soil mixture through vacuum hose 14 into tank 44 where most of the cleaning liquid and soil separate from the air and are retained in the tank.

The air expelled from vacuum pump 46 through discharge pipe 49 contains a considerable amount of heat, particularly heat generated by the compressive action of the vacuum pump 46. For example, air may enter vacuum pump at around 120° F.–130° F. and exit it at the temperature of around 200° F. This air, after passing through muffler 51 and separator 52, flows through a continuation of discharge pipe 49 to the first heat exchanger 63 where the heat therein can be imparted to the cleaning liquid flowing through pipe 61.

In accordance with this invention the cleaning liquid is also heated in first heat exchanger 43 by heat from the exhaust gases of the internal combustion engine 60. This is preferably accomplished by conveying these gases through an exhaust pipe 43 to an air mixing chamber 66 in communication with the interior of first heat exchanger 63. Vacuum pump discharge pipe 49 also communicates with mixing chamber 66. Thus, air leaving vacuum pump 46 and engine exhaust gases flowing through exhaust pipe 43 are brought together in mixing chamber 66 and the quantities of heat therein are combined before entering heat exchanger 63.

Exhaust gases from engine 60 may be at a temperature of 1000° to 1200° F. Air leaving the vacuum pump 46 will normally have a temperature of around 200° F. When these two gases are mixed the resulting mixture will have a temperature of something less than exhaust gas temperature and greater than vacuum pump discharge gas temperature. Preferably, the mixture entering heat exchanger 63 is within a temperature range of about 375° F. to 400° F. This gas mixture passing through heat exchanger 63 preferably is capable of heating 70° F. cleaning liquid to a temperature of 140° F. to 150° F.

It will be noted that by pre-heating the cleaning liquid in heat exchanger 63 with a mixture of engine exhaust gases and vacuum pump discharge air the heat from these two sources can be effectively utilized with little danger of overheating the cleaning liquid. Thus, there is no need for the thermostatically controlled dump valve employed in the heating and retrieval system of FIG. 2.

If desired, the mixing chamber 66 can be equipped with a flow control valve 67 for adjusting the relative quantities of exhaust gases and pump discharge air entering heat exchanger 63. And this may include bypassing some of either of these gases through a discharge port 68.

Secondary heating of cleaning liquid to the desired cleaning range of 170° to 200° F. is accomplished in heat exchanger 64 utilizing heat extracted from engine 60 via a cooling system. That system includes a coolant pump 69 driven by engine 60 through a belt drive 70. Pump 69 moves liquid coolant through a circuit of pipes 71 from around the cylinders (not shown) of engine 60 through second heat exchanger 64 and back to the engine 60. Any heat losses in coolant pump 69 are imparted to the circulating coolant and are available to heat the cleaning liquid in heat exchanger 64.

What is claimed is:

1. A cleaning system comprising cleaning liquid, a liquid heating system, a spray nozzle for spraying heated liquid onto a surface to be cleaned, a vacuum nozzle for retrieving liquid sprayed by said spray nozzle, a vacuum pump having an inlet and an outlet, means connecting the inlet of said vacuum pump to said vacuum nozzle for withdrawing liquid and air into said vacuum nozzle, and means connected to the outlet of said vacuum pump for conveying air leaving said pump to said liquid heating system to impart heat from said air to said cleaning liquid.

2. The cleaning system of claim 1 further comprising an internal combustion engine for driving said vacuum pump, said engine producing heated exhaust gases when operating, and means for conveying said exhaust gases to said liquid heating system to impart heat from said exhaust gases to said cleaning liquid.

3. The cleaning system of claim 2 further comprising means for mixing the heat from the air leaving said pump with the heat from said exhaust gases before conveying the heat mixture to said cleaning liquid 4. The cleaning system of claim 3 further characterized in that said last named means admixes the air leaving said pump with said exhaust gases and then conveys the mixture in heat exchange relationship with said cleaning liquid.

5. The cleaning system of claim 2 further comprising a cooling system for said engine and means for conveying heat extracted from said engine by said cooling system to said cleaning liquid.

6. The cleaning system of claim 5 further comprising a coolant pump in said cooling system, said coolant pump being driven by said engine.

7. A cleaning system comprising cleaning liquid, a liquid heating system, a spray nozzle for spraying heated liquid onto a surface to be cleaned, a vacuum nozzle for retrieving liquid sprayed by said spray nozzle, a vacuum pump having an inlet and an outlet, means connecting the inlet of said vacuum pump to said vacuum nozzle for withdrawing liquid and air into said vacuum nozzle, means connected to the outlet of said vacuum pump for conveying air away from said vacuum pump, an internal combustion engine for driving said vacuum pump, said engine producing heated exhaust gases when operating, means for conveying said exhaust gases away from said engine, means for mixing the air conveyed away from said pump with exhaust gases conveyed away from said engine and means for conveying that mixture to said liquid heating system for heating said cleaning liquid.

8. The cleaning system of claim 7 further comprising a cooling system for said engine and means for conveying heat extracted from said engine by said cooling system to said cleaning liquid.

9. The cleaning system of claim 8 further characterized in that the heat from said cooling system is conveyed to said cleaning liquid after the heat from said mixture is conveyed to the cleaning liquid.

* * * * *